US007535421B2

(12) United States Patent
Tseng et al.

(10) Patent No.: US 7,535,421 B2
(45) Date of Patent: May 19, 2009

(54) ANTENNA ASSEMBLY WITH IMPROVED RADIATING EFFECT

(75) Inventors: Hsien-Sheng Tseng, Tu-Cheng (TW); Lung-Sheng Tai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 43 days.

(21) Appl. No.: 11/906,364

(22) Filed: Oct. 1, 2007

(65) Prior Publication Data

US 2008/0094289 A1 Apr. 24, 2008

(51) Int. Cl.
*H01Q 1/38* (2006.01)
*H01Q 5/00* (2006.01)
*H01Q 9/04* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,801,169 B1 10/2004 Hai
7,119,748 B2 * 10/2006 Autti ..... 343/702
2004/0178957 A1 * 9/2004 Chang et al. ..... 343/700 MS

* cited by examiner

*Primary Examiner*—Anh Q Tran
(74) *Attorney, Agent, or Firm*—Wei Te Chung

(57) ABSTRACT

An antenna assembly includes a supporter forming two different continuous first and second surfaces, and a monopole antenna assembled on the supporter and comprising a radiating element comprising a first radiating portion, a second radiating portion respectively worked at different frequency bands, and a grounding element separated from the radiating element; wherein the first radiating portion, the radiating portion and the grounding element connecting together across the first and second surfaces to form a solid antenna.

18 Claims, 2 Drawing Sheets

ANTENNA ASSEMBLY WITH IMPROVED RADIATING EFFECT

BACKGROUND OF THE INVENTION

1. Field of the Invention

The present invention relates generally to an antenna assembly, and more particularly to an antenna assembly assembled in a movable electronic device.

2. Description of the Prior Art

Since the wireless communication technology of using electromagnetic wave to transmit signals has the effect of remote device transmission without cable connection, and further has the mobility advantage, therefore the technology is widely applied to various products, such as moveable phones, notebook computers, intellectual home appliance with wireless communication features. Because these devices use electromagnetic wave to transmit signals, the antenna used to receive electromagnetic wave also becomes a necessity in the application of the wireless communication technology. In present electronic device, antennas always be assembled in the electronic device to make the appearance of the device beauty. Since the limited of the inner space of the electronic device, the height and size of antenna will be restricted. Thus, the antenna is required to be of small-size with good performance. U.S. Pat. No. 6,801,169 discloses a small-size dual-band monopole antenna. The monopole antenna is fixed on a PCB, and comprises a C-shape radiating element, an L-shape grounding element and a feeding line connecting to the radiating element and the grounding element. However, the radiating element of the antenna and the grounding element are on the same plane that the antenna is easily influenced by the electronic components therearound to have some radiating blind areas.

Hence, an antenna assembly is desired to overcome the above-mentioned shortcomings of the existing antennas.

BRIEF SUMMARY OF THE INVENTION

A primary object, therefore, of the present invention is to provide an antenna assembly which is of small-size and easy for assembling itself on an electronic device with few radiating blind area.

In order to implement the above object and overcomes the above-identified deficiencies in the prior art, the antenna assembly comprises a supporter forming two different continuous first and second surfaces, and a monopole antenna assembled on the supporter and comprising a radiating element comprising a first radiating portion, a second radiating portion respectively worked at different frequency bands, and a grounding element separated from the radiating element; wherein the first radiating portion, the radiating portion and the grounding element connecting together across the first and second surfaces to form a solid Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
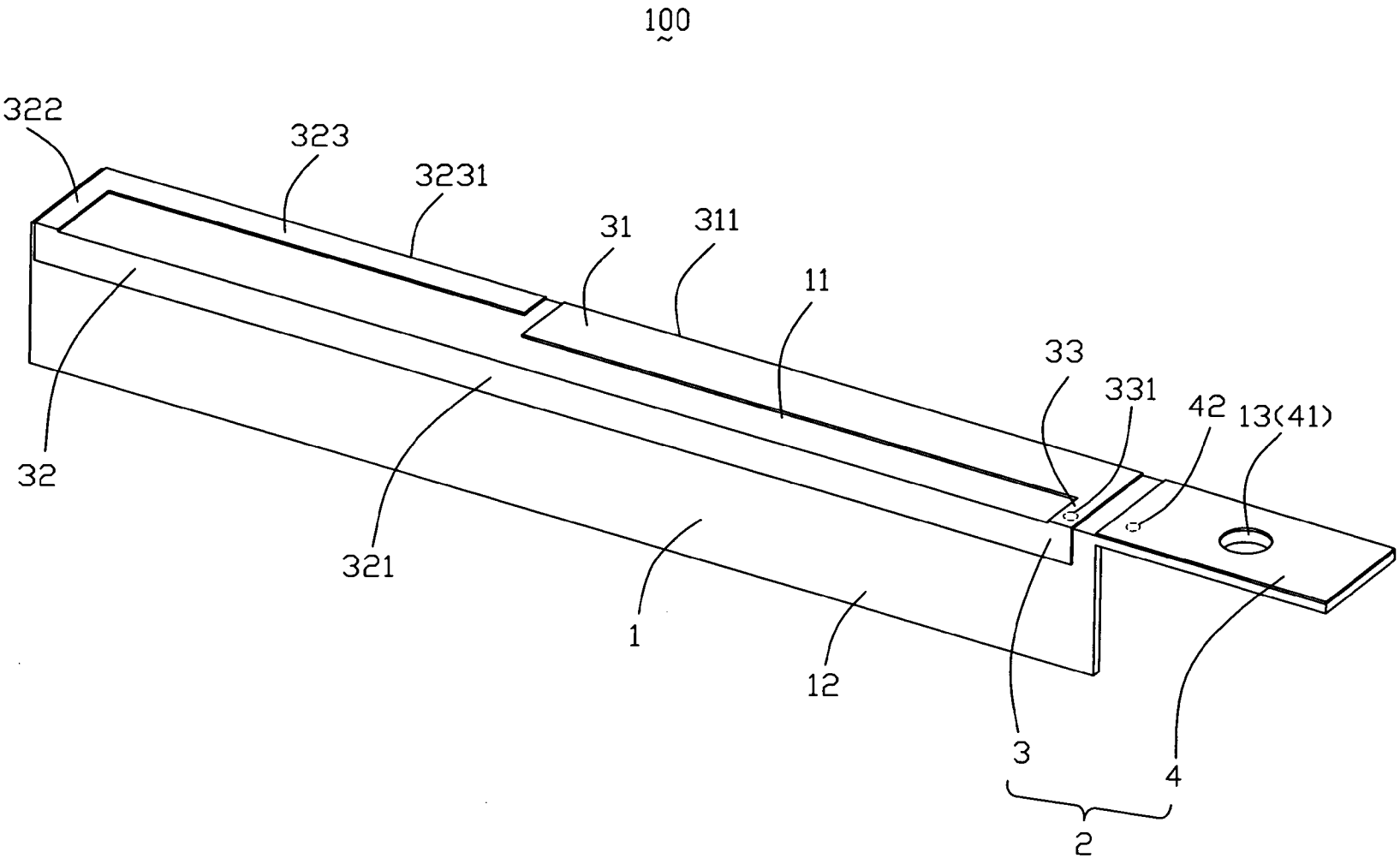
FIG. 1 is a perspective view illustrating of the preferred embodiment of the present invention.
Figure 2:
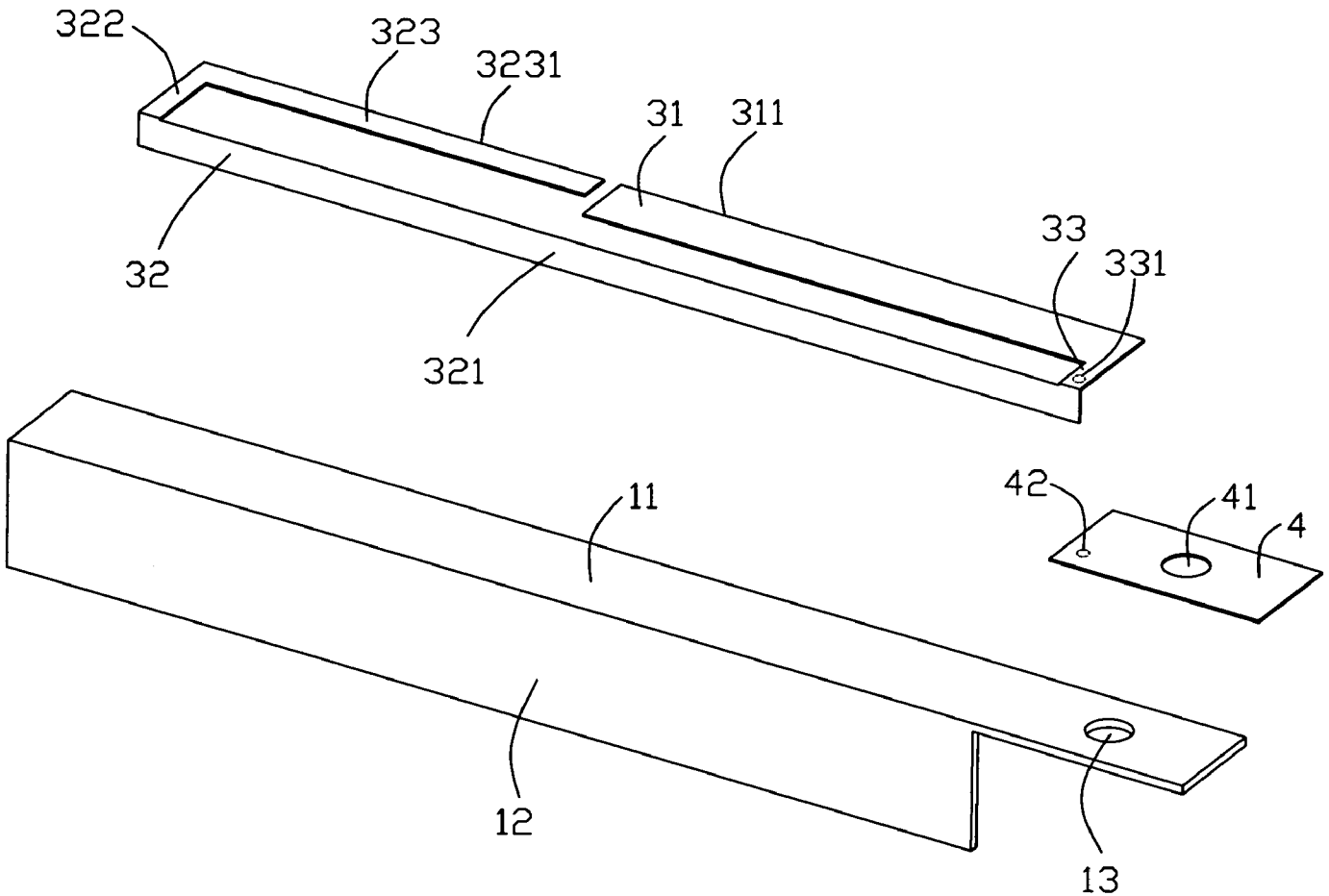
FIG. 2 is a exploded perspective view illustrating of the FIG. 1.

Reference to FIG. 1 to FIG. 2, perspective views of an antenna assembly 100 in accordance with a preferred embodiment of the present invention are shown.

The antenna assembly 100 comprises a supporter 1 and a monopole antenna 2 made of a metal patch and assembled on the supporter 1. The monopole antenna 2 comprises a radiating element 3 and a grounding element 4. The shape and the size of the supporter 1 are designed to adapt to the inner space of the electronic device. In this embodiment, the supporter 1 is made of a kind of insulative material and comprises a first insulative substrate 11 located in a horizontal plane and defining a circular hole 13 at right end thereof and a second insulative substrate 2 shorter than the first insulative substrate 11 and extending downwardly from edge of the first insulative substrate 11 to be located in a vertical plane. Thus, the first insulative substrate 11 is perpendicular to the second insulative substrate 12.

The radiating element 3 comprises a wider first radiating portion 31 located in the horizontal plane, a thinner second radiating portion 32 and a connecting portion 33 connecting the first radiating portion 31 with the second radiating portion 32. The second radiating portion 32 comprises a first radiating arm 321 located in the vertical plane with a length substantially equal to that of the second insulative substrate 12, a second radiating arm 322 extending from of the first radiating arm 321 in a direction perpendicular to the first radiating arm 321 and located in the horizontal plane with a length substantially equal to the width of the insulative substrate 11, a third radiating arm 323 extending from the second radiating arm 322 to a free end in a direction perpendicular to the second radiating arm 322. The free end of the third radiating arm 323 is adjacent to the first radiating portion 321 with a gap formed therebetween. The grounding element 4, first radiating portion 31, and the connecting portion 33, the second radiating arm 322 and the third radiating arm 323 are plastered on the upper surface of the first insulative substrate 11. The first radiating arm 321 of the second radiating portion 32 is plastered on the second insulative substrate 12. In other embodiments, the monopole antenna 2 can be assembled on the supporter with some other methods.

The first radiating portion 31 has an outer first side edge 311. The third radiating arm 323 has an outer second side edge 3231 on a level same as the first side edge 311. The first radiating portion 31, the second radiating portion 32 and the connecting portion combine to C shape. The first radiating portion 31 is used to receive and send signal of a first frequency band, and the second radiating portion 32 works at a second frequency band. In this embodiment, the first frequency band is from 1710 to 2170 MHz, and the second frequency band is 824-960 MHz.

The grounding element 4 is separated from the radiating element 3 and comprises a circular aperture 41 in a middle thereof. The aperture 41 corresponds with the hole 13 to form a through hole. The through hole is used to be a part of a fastening system fastening the antenna assembly 100 on the electronic device. The monopole antenna 2 has a feeding line (not shown), and the feeding line has an inner conductor connecting any one point of the connecting portion 33 to form a feeding point 331, and an outer conductor connecting the grounding element 4 to form a grounding point 42.

The design, superposing the hole 13 and the aperture 41 and clinging the solid radiating element being C shape to the solid supporter 1, can make the monopole antenna 2 have small-size, small blind areas, good performance without reducing the band width of the antenna.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna assembly, comprises:

a supporter forming two different continuous first and second surfaces; and a monopole antenna assembled on the supporter and comprising a radiating element comprising a first radiating portion, a second radiating portion respectively worked at different frequency bands, and a grounding element separated from the radiating element;

wherein the first radiating portion, the second radiating portion and the grounding element connecting together across the first and second surfaces to form a solid antenna.

2. The antenna assembly as claimed in claim 1, wherein said supporter comprises a first substrate defining the first surface and a second substrate defining the second surface.

3. The antenna assembly as claimed in claim 2, wherein said first substrate is perpendicular to the second substrate.

4. The antenna assembly as claimed in claim 1, also comprises a connecting portion connecting the first radiating portion and the second radiating portion and providing a feeding point.

5. The antenna assembly as claimed in claim 4, wherein said second radiating portion comprises a first radiating arm located in the vertical plane with a length substantially equal to that of the second insulative substrate, a second radiating arm extending from the first radiating arm in a direction perpendicular to the first radiating arm and located in the horizontal plane with a length substantially equal to the width of the first insulative substrate, and a third radiating arm extending from the second radiating arm in a direction perpendicular to the second radiating arm.

6. The antenna assembly as claimed in claim 5, wherein said first radiating portion, the grounding element, the second radiating arm, the third radiating arm and the connecting portion are on the first surface defined by the supporter.

7. The antenna assembly as claimed in claim 6, wherein said first radiating arm of the second radiating portion is on the second surface defined by the supporter.

8. The antenna assembly as claimed in claim 5, wherein said third radiating arm is adjacent to the first radiating portion with a gap formed therebetween.

9. The antenna assembly as claimed in claim 7, wherein said supporter comprises an aperture, and the monopole antenna comprises a hole superposing the aperture to form a through hole.

10. The antenna assembly as claimed in claim 9, wherein said hole is on the grounding element which is on the first surface longer than the second surface.

11. The antenna assembly as claimed in claim 4, also comprises a feeding line having an inner conductor connecting any one point of the connecting portion to form the feeding point and an outer conductor connecting the grounding element to form a grounding point.

12. The antenna assembly as claimed in claim 1, wherein said first radiating portion, the second radiating portion and the connecting portion combine to C shape.

13. The antenna assembly as claimed in claim 1, wherein said the first radiating portion works at a first frequency band and the second radiating portion works at a second frequency band.

14. The antenna assembly as claimed in claim 13, wherein said first frequency band is on 1710-2170 MHz, and the second frequency band is on 824-960 MHz.

15. An antenna assembly comprising:

a C-shaped radiating element essentially defining, along a lengthwise direction, a main elongated straight segment with a first L-shaped segment and second L-shaped segment extending at two opposite ends of said main elongated straight segment;

a supporter defining extending lengthwise along said lengthwise direction and defining at least adjacent first and second surfaces angled and intersected with each other;

said main elongated straight segment and said first and second L-shaped segments being located on said first and second surfaces, respectively;

a grounding element spaced from said radiating element in said lengthwise direction.

16. The antenna assembly as claimed in claim 15, wherein said grounding element is located on said second surface.

17. The antenna assembly as claimed in claim 16, wherein said second L-shaped segment is closer to the grounding element than the first L-shaped segment.

18. The antenna assembly as claimed in claim 17, wherein said second L-shaped segment is larger than said first L-shaped segment.

* * * * *